US005917453A

United States Patent [19]

Uchino et al.

[11] Patent Number: 5,917,453

[45] Date of Patent: Jun. 29, 1999

[54] ILLUMINANT-MOUNTED ANTENNA

[75] Inventors: Shigeru Uchino, Yokohama; Katsuhiko Yamakawa, Tokyo, both of Japan

[73] Assignee: Harada Industry Co., Ltd., Tokyo, Japan

[21] Appl. No.: 08/812,432

[22] Filed: Mar. 7, 1997

[30] Foreign Application Priority Data

Mar. 7, 1996 [JP] Japan ..... 8-050272

[51] Int. Cl.[6] ..... H01Q 1/06

[52] U.S. Cl. ..... 343/721; 343/894; 343/703

[58] Field of Search ..... 343/721, 703, 343/894; 324/95; 128/653.1; H01Q 1/06

[56] References Cited

U.S. PATENT DOCUMENTS 2,522,189 9/1950 Morrow ..... 174/48

FOREIGN PATENT DOCUMENTS 406164224 6/1994 Japan ..... H01Q 1/06
6237108 8/1994 Japan .
3007220 11/1994 Japan .

*Primary Examiner*—Don Wong
*Assistant Examiner*—Jennifer H. Malos
*Attorney, Agent, or Firm*—John P. White; Cooper & Dunham LLP

[57] ABSTRACT

An illuminant-mounted antenna includes a rod-shaped antenna element, an illuminant mounted on top of the rod-shaped antenna element, and lighting means for lighting the illuminant by high frequency energy generated on the rod-shaped antenna element when a portable transceiver is operated. The lighting means includes a high frequency detecting diode and an inductive element. One end of the high frequency detecting diode and one end of the inductive element are connected in common to the top of the rod-shaped antenna element, and the other end of the high frequency detecting diode and the other end of the inductive element are connected to both ends of the illuminant. It is preferable that the rod-shaped antenna element be a whip antenna element capable of transmitting/receiving a very-high-frequency radio wave and an ultra-high-frequency radio wave, and an antenna element mounted on the portable transceiver, the illuminant be a light-emitting diode whose current ranges from 10 mA to 20 mA, and the inductive element be a coil whose inductance ranges from 13 nH to 40 nH.

7 Claims, 3 Drawing Sheets

ILLUMINANT-MOUNTED ANTENNA

BACKGROUND OF THE INVENTION

The present invention relates to an antenna attached to a portable transceiver such as a portable telephone and a PHS (personal handy phone) terminal and, more particularly, to an antenna with an illuminant attached to the top of a rod-shaped antenna element and lit by high-frequency energy generated on the rod-shaped antenna element during the operation of the transceiver.

One example of a conventional antenna is disclosed in Jpn. U.M. Appln. KOKAI Publication No. 5-9008. This antenna has an illuminant such as a semiconductor light emitting device. The illuminant is mounted on the top of a very-high-frequency whip antenna element or an ultra-high-frequency whip antenna element such that the distribution of high-frequency voltages of the antenna element has the maximum, and turned on by the output power of a transmitter.

When the transmitter is operated to emit a radio wave from the antenna element, a high-frequency voltage is applied to one of terminals of the illuminant, while the other terminal thereof is connected to the earth through stray capacity in the air. Thus, current flows through the illuminant, and the illuminant is lit by the output power of the transmitter.

The above-described antenna can be employed as an antenna assuming a very interesting characteristic that the illuminant mounted on the top of the antenna element is lit without providing a specific lighting power supply or lighting circuit.

Since the illuminant of the above conventional antenna is automatically turned on during the operation of the transmitter, a display function of indicating the operation state and the present location of the antenna can be fulfilled. Since, moreover, the antenna does not need any specific power supply device or the like, its structure is simple and its manufacture is easy.

The conventional antenna described above, however, has the following drawback. The antenna is not so high in operating efficiency that it cannot be turned on quickly if the output power of the transmitter is lowered.

Generally, a portable telephone is employed lowering its output in an area of a strong electric field in order to lessen the consumption of an incorporated battery as much as possible and lengthen the use time of the portable telephone.

If the conventional antenna mounted with an illuminant is applied to the above portable telephone, the output of the portable telephone is lowered when the telephone is used in an area of a strong electric field. Thus, high-frequency energy generated on a rod-shaped antenna element becomes small and the illuminant is not turned on.

BRIEF SUMMARY OF THE INVENTION

It is accordingly an object of the present invention to provide an illuminant-mounted antenna which is capable of generating a relatively high detection voltage even when high-frequency energy generated on a rod-shaped antenna element is very small and which includes a lighting means for stably and exactly lighting an illuminant mounted on top of the rod-shaped antenna element.

To achieve the above object, the illuminant-mounted antenna according to the present invention has the following construction.

The illuminant-mounted antenna includes a rod-shaped antenna element, an illuminant mounted on top of the rod-shaped antenna element, and lighting means for lighting the illuminant by high frequency energy generated on the rod-shaped antenna element when a portable transceiver is operated.

The lighting means includes a high frequency detecting diode and an inductive element. One end of the high frequency detecting diode and one end of the inductive element are connected in common to the top of the rod-shaped antenna element, and the other end of the high frequency detecting diode and the other end of the inductive element are connected to both ends of the illuminant.

It is preferable that the rod-shaped antenna element be a whip antenna element capable of transmitting/receiving a very-high-frequency radio wave and an ultra-high-frequency radio wave, and an antenna element mounted on the portable transceiver, the illuminant be a light-emitting diode whose current ranges from 10 mA to 20 mA, and the inductive element be a coil whose inductance ranges from 13 nH to 40 nH.

Additional objects advantages of the invention will be set forth in the description which follows, and in part will be obvious from the description, or may be learned by practice of the invention. The objects and advantages of the invention may be realized and obtained by means of the instrumentalities and combinations particularly pointed out in the appended claims

BRIEF DESCRIPTION OF THE SEVERAL VIEWS OF THE DRAWING

The accompanying drawings, which are incorporated in and constitute a part of the specification, illustrate presently preferred embodiment of the invention, and together with the general description given above and the detailed description of the preferred embodiment given below, serve to explain the principles of the invention.

DETAILED DESCRIPTION OF THE INVENTION

(Embodiment)

Figure 1:
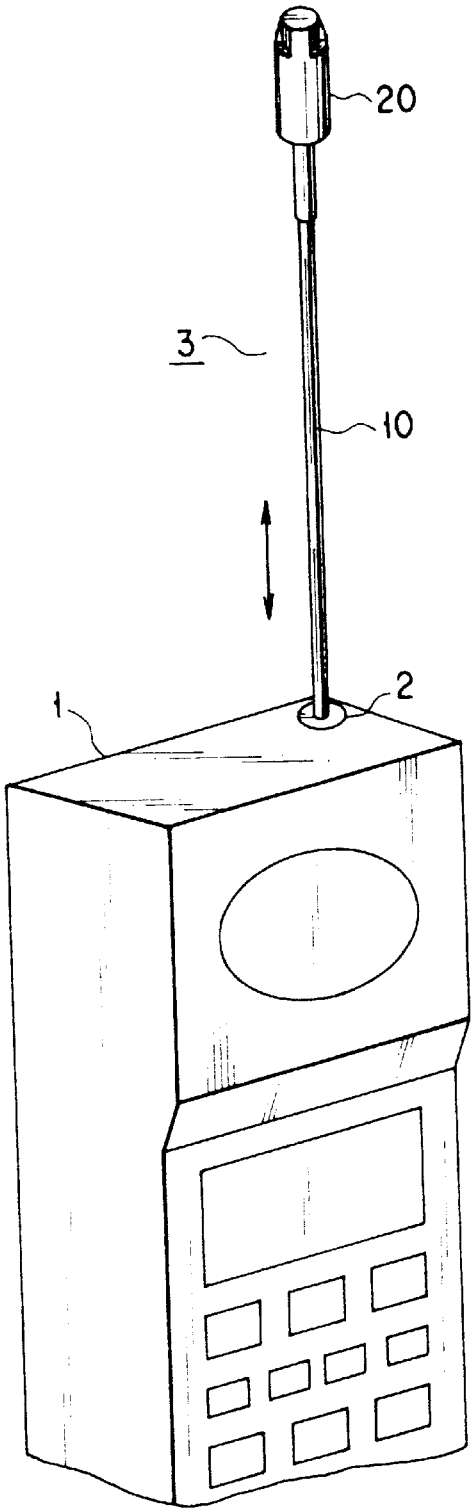
FIG. 1 is a perspective view schematically showing the constitution of an illuminant-mounted antenna according to one embodiment of the present invention.
Figure 3:
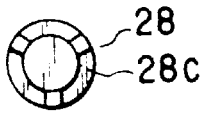
FIG. 3 is a top view of the light emitting mechanism of the antenna shown in FIG. 1.
Figure 2:
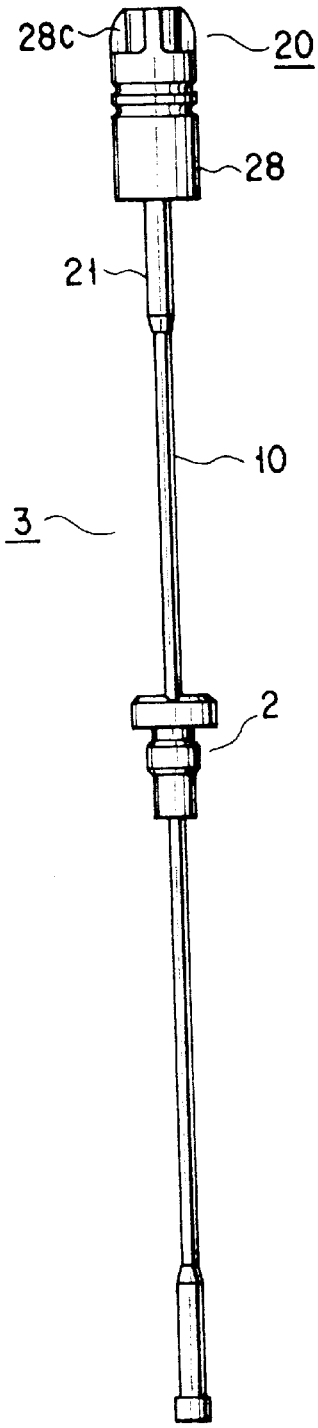
FIG. 2 is a side view of an antenna element and a light emitting mechanism of the antenna shown in FIG. 1.

FIGS. 1 to 3 are views schematically showing an illuminant-mounted antenna according to one embodiment of the present invention. A portable telephone 1 shown in these figures employs an ultra-high-frequency radio wave of 800 MHz, 1.5 GHz or the like. An illuminant-mounted antenna 3 is attached to a case of the portable telephone 1 in such a manner that it can be freely inserted into and removed from the case in the directions indicated by the arrows in FIG. 1. The antenna 3 includes a rod-shaped antenna element 10 of a whip antenna element capable of transmitting/receiving a very-high-frequency radio wave and an ultra-high-frequency radio wave and a light-emitting mechanism 20 mounted on the top of the antenna element 10.

Figure 4:
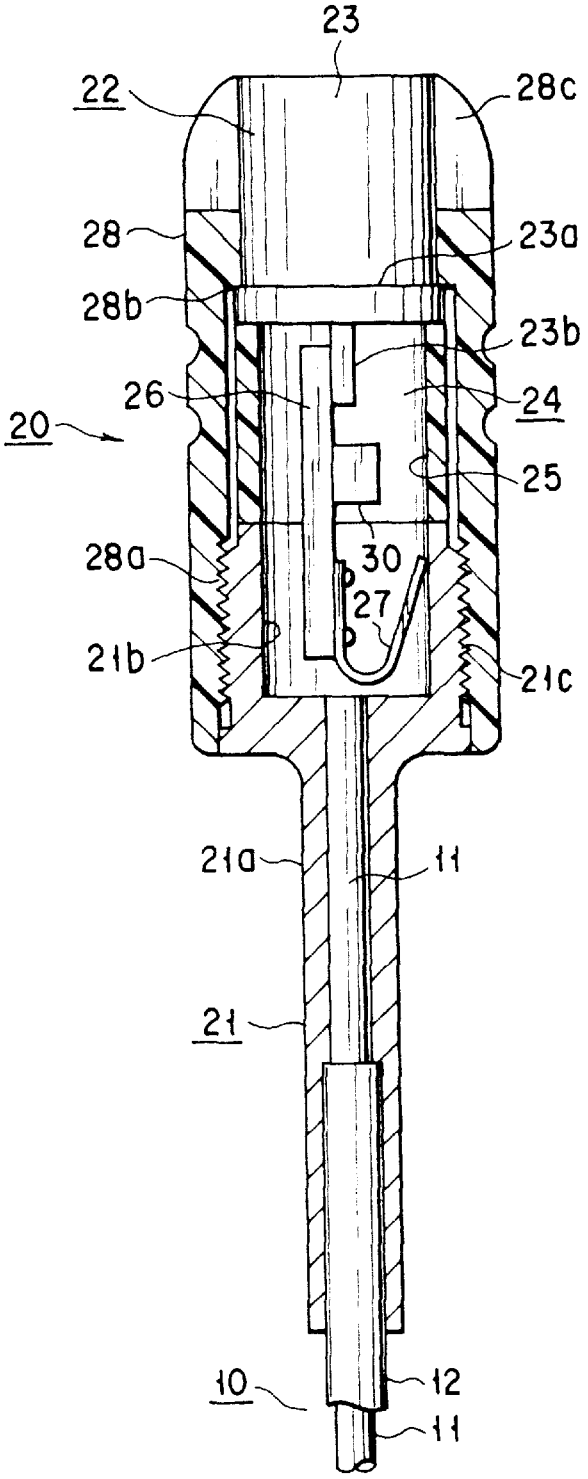
FIG. 4 is an enlarged sectional view of the light emitting mechanism of the antenna shown in FIG. 1.

FIG. 4 is an enlarged sectional view showing in detail the constitution of the light-emitting mechanism 20 illustrated in FIGS. 1 and 2. Referring to FIG. 4, the rod-shaped antenna element 10 is obtained by coating the surface of an antenna element body 11, which is constituted of a rod-shaped elastic metal member, with an insulation tube 12 formed of resin or the like. The insulation tube 12 is peeled off the top of the antenna element 10 and the antenna element body 11 is exposed therefrom.

The light-emitting mechanism 20 is constituted by a cylindrical holder 21 of a conductive material and the holder 21 serves as a base of the mechanism 20. The holder 21 includes a small-diameter cylindrical section 21*a* at its base portion (a lower portion in FIG. 4) and a large-diameter cylindrical section 21*b* at its top portion (an upper portion in FIG. 4). The small-diameter cylindrical section 21*a* is fixed on and around the tip portion of the rod-shaped antenna element 10, including the exposed portion of the antenna element body 11, in such a manner that they are tightly close to each other. The large-diameter cylindrical section 21*b* has an opening at its upper end.

An illuminant unit 22 is removably inserted into the hollow of the large-diameter cylindrical section 21*b* through the opening thereof. The unit 22 is an integrated component of both a light-emitting diode 23 serving as an illuminant and a lighting means 24 for efficiently lighting the diode 23. It is preferable that a light-emitting diode of 10 mA, 20 mA or the like, which is on the market, be used for the light-emitting diode 23. It is also preferable to use a light-emitting diode of 1 mA, depending on the conditions of use. In other words, a light-emitting diode of 20 mA or lower can be used in this embodiment.

The lighting means 24 is constituted of a cylindrical mounting housing 25 formed of, e.g., synthetic resin, a printed circuit board 26, a conductive contact spring 27 and a circuit element 30. One opening portion of the mounting housing 25 is fixed to a flange portion 23*a* of the light-emitting diode 23. One end of the printed circuit board 26 is inserted into the mounting housing 25 through the other opening portion thereof. Both side edges of the inserted portion of the printed circuit board 26 are fixed by the inside periphery of the housing 25. A terminal portion (not shown) of the printed circuit board 26 is electrically connected to a terminal portion 23*b* of the light-emitting diode 23. The conductive contact spring 27 is formed by curving an elastic metal member such as a phosphor piece, like a letter "J" and one end of the curved member is fixed to the other end of the printed circuit board 26.

If the printed circuit board 26 is inserted into the large-diameter cylindrical portion 21*b* of the holder 21, one end portion of the conductive contact spring 27 contacts the inner circumference of the large-diameter cylindrical portion 21*b* at a predetermined pressure. As a result, the terminal portion of the printed circuit board 26 and the large-diameter cylindrical portion 21*b* of the holder 21 electrically conduct to each other.

The circuit element 30 is mounted on the printed circuit board 26 and inserted into an electrical circuit connecting the terminal portion 23*b* of the light-emitting diode 23 and the conductive contact spring 27. The electrical circuit including the circuit element 30 will be described later.

A lock mounting cap 28 formed of, e.g., synthetic resin is put on the outer circumference of the illuminant unit 22. The cap 28 as a whole is shaped substantially cylindrically. A female screw portion 28*a* is provided on the inner circumference of a base portion (a lower portion in FIG. 4) of the cylindrical section of the cap 28. A step portion 28*b* is provided on the inner circumference of a middle portion of the cylindrical section. Furthermore, a slit portion 28*c* is formed at an angle of 120° in the top portion (an upper portion in FIG. 4) of the cylindrical section.

If, therefore, the female screw portion 28*a* of the mounting cap 28 is fixed to a male screw portion 21*c* formed on the outer circumference of the cylindrical section 21*b* while the illuminant unit 22 is inserted into the large-diameter cylindrical portion 21*b* of the holder 21, the step portion 28*b* of the cap 28 stops a flange portion 23*a* of the light-emitting diode 23. The illuminant unit 22 is fixed to the holder 21 as one component. In this state, the light emitted from the light-emitting diode 23 can be radiated outside through the slit portion 28*c* of the mounting cap 28.

In order to exchange the light-emitting diode 23, the mounting cap 28 can be detached from the holder 21 through an operation opposite to that described above, and thus the illuminant unit 22 can easily be separated from the holder 21.

When an operation of attaching/detaching the mounting cap 28 is performed, the slit portion 28*c* serving as a window through which light is emitted, can be employed as a slit for rotating a tool. More specifically, by inserting the tip of a tool such as a tubular box spanner and a screwdriver into the slit section 28*c* and rotating it, the mounting cap 28 can be rotated quickly and exactly.

Figure 5:
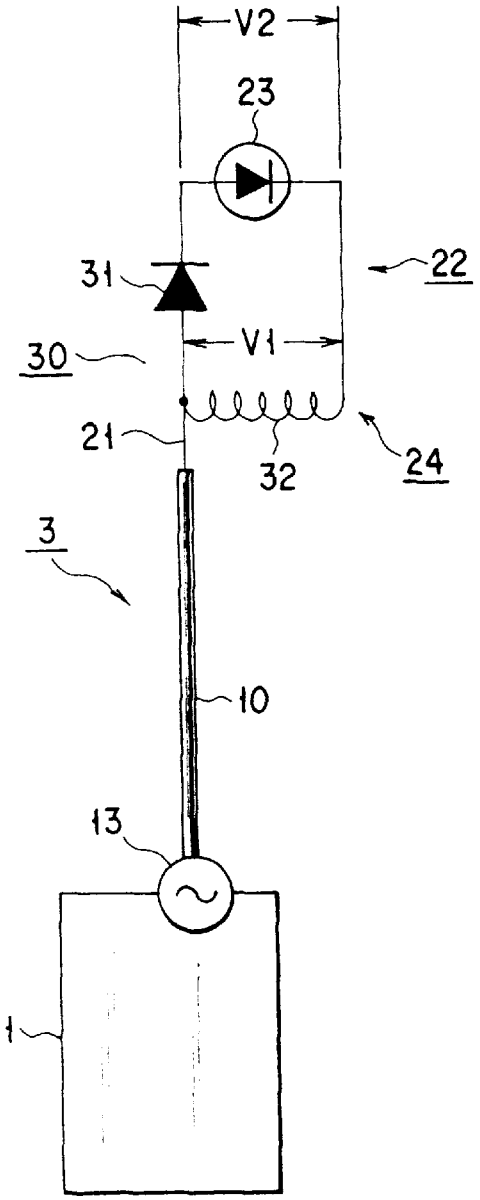
FIG. 5 is a view of an equivalent circuit of the antenna shown in FIG. 1.

FIG. 5 is a view of an equivalent circuit of the antenna 3 according to the first embodiment of the present invention. As illustrated in FIG. 5, the light-emitting diode 23 is connected to the top of the rod-shaped antenna element 10 through the circuit element 30 which is the main component of the lighting means 24. The circuit element 30 is constituted of a high frequency detecting diode 31 and an inductive element (coil) 32, and the anode of the diode 31 and one end of the inductive element 32 are connected in common to the top of the antenna element 10 (specifically the holder 21). As shown in FIG. 5, the light-emitting diode 23 is connected between the cathode of the diode 31 and the other end of the inductive element 32 so as to have the same polarity as that of the diode 31. In FIG. 5, reference numeral 13 indicates an antenna feeder.

In this embodiment described above, a light-emitting diode of 20 mA or less (e.g., 10 mA), which is on the market, is used for the diode 23, while an inductive element having an inductance of 22 nH or less is used for the inductive element 32.

According to the antenna 3 with an illuminant having the above-described constitution, when the portable telephone 1 is in use, that is, when a radio wave is radiated through the antenna element 10 at an incoming call or during a call, a high frequency inductive voltage of V1 is generated at each terminal of the inductive element 32. The inductive voltage V1 is rectified by the high frequency detecting diode 31 into a DC voltage (pulsating current) V2 containing a pulsating component, and the DC voltage is applied to the light-emitting diode 23. A current flows through the light-emitting diode 23 and thus the diode 23 is lit by the high frequency energy of the portable telephone 1.

In the foregoing embodiment of the present invention, a detection voltage can be generated efficiently since the single high frequency detecting diode 31 is employed as a detecting diode of the circuit element 30, the high frequency inductive voltage V1 is used as a voltage applied to the light-emitting diode 23, and the like. Therefore, even though the output of the portable telephone 1 is automatically lowered in an area of a strong electric field and only a small power is supplied to the antenna, the light-emitting diode 23 can be lit satisfactorily.

(Experimental Results)

Figure 6:
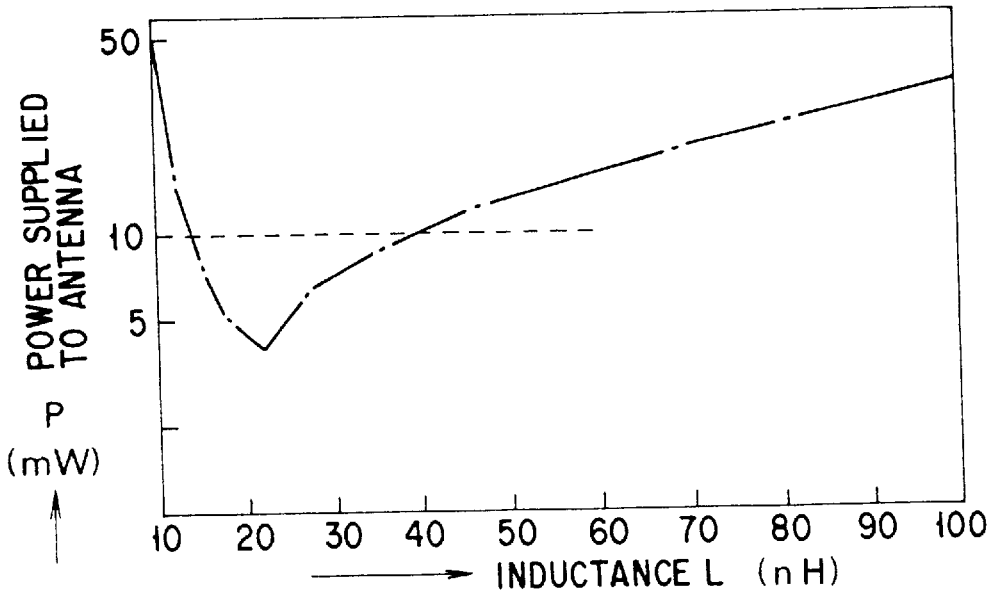
FIG. 6 is a graph representing results of experiment on the antenna shown in FIG. 1 to find the optimum inductance of an inductive element.
Figure 7:
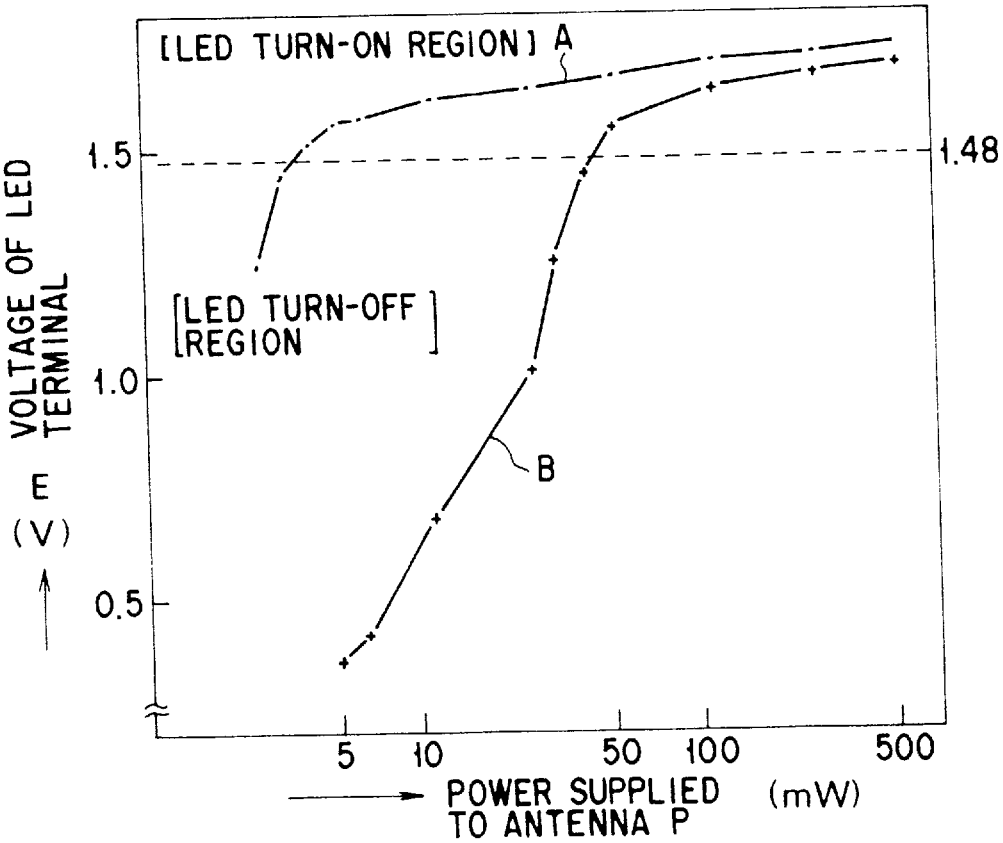
FIG. 7 is a graph representing a comparison between lighting characteristic A of a light emitting diode of the antenna shown in FIG. 1 and lighting characteristic B of a light emitting diode of a conventional antenna.

FIGS. 6 and 7 are graphs representing the results of experiments on the antenna 3 with an illuminant according to the above-described embodiment.

The graph of FIG. 6 represents the result of an experiment for finding the optimum inductance of the inductive element 32. In this experiment, when the light-emitting diode 23 is of a 10 mA type and a transceiver is operated at a frequency of 904 MHz, the minimum values of power P(mW) supplied to the antenna to start lighting the diode 23 are measured for ten kinds of inductive elements 32. Ten coils having inductances 10 nH to 100 nH are selected as the inductive elements 32.

It is apparent from FIG. 6 that if the current used in the light-emitting diode is 10 mA and the frequency of an radio wave used in the transceiver is about 904 MHz, a coil having an inductance of about 22 nH is the most suitable for the inductive element 32 and the light-emitting diode can be lit even at a power of 10 mW or less. The current used in the light-emitting diode 23 can be 20 mA or 1 mA, and the frequency of the radio wave can be 800 MHz or 1.5 GHz.

The graph of FIG. 7 represents the result of a comparison between lighting characteristic A of the light-emitting diode 23 of the antenna according to the above embodiment of the present invention using a coil having an inductance of 22 nH and lighting characteristic B of the light-emitting diode B of the prior art antenna. In this comparison, when the light-emitting diode is of a 10 mA type and the transceiver is operated at a frequency of 904 MHz, variations in terminal voltage E(V) of the light-emitting diode with the power P(mW) supplied to the antenna are measured. The terminal voltage E at which the 10 mA type light-emitting diode starts to be lit is 1.48V. Consequently, the light-emitting diode is turned on at a voltage higher than the level (1.48V) indicated by the broken line in FIG. 7, while it is turned off at a voltage not higher than the level.

It is apparent from characteristic A in FIG. 7 that the light-emitting diode can be lit even when a small power P of about 4 mW is supplied to the antenna according to the present invention using a coil having an inductance of about 22 nH as the inductive element 32. On the other hand, it is apparent from characteristic B in FIG. 7 that the light-emitting diode is not lit unless a power of at least 50 mW is supplied to the conventional antenna having no inductive element.

(Modifications)

The antenna 3 with an illuminant according to the above embodiment (including the experiments shown in FIGS. 6 and 7) includes the following modifications:

i) The directions of a light-emitting diode and a high frequency detecting diode are opposite to those of the diodes 23 and 31 shown in FIG. 3; and ii) The slit section 28*c* is replaced with a mounting cap 28 having a light irradiation window formed by a light transmitting member.

iii) The lighting means 24 includes means for cyclically turning on and off the illuminant 23.

(Merits of the Embodiment)

The following are the advantages of the antenna according to the above embodiment of the present invention including the experiments and their modifications:

(I) An illuminant-mounted antenna (3) according to the above embodiment of the present invention comprises a rod-shaped antenna element (10), an illuminant (23) mounted on top of the rod-shaped antenna element (10), and lighting means (24) for lighting the illuminant (23) by high frequency energy generated on the rod-shaped antenna element (10) when a portable transceiver (1) is operated.

The lighting means (24) includes a high frequency detecting diode (31) and an inductive element (32), one end of the high frequency detecting diode (31) and one end of the inductive element (32) are connected in common to the top of the rod-shaped antenna element (10), and the other end of the high frequency detecting diode (31) and the other end of the inductive element (32) are connected to both ends of the illuminant (23).

In the illuminant-mounted antenna (3), a high frequency inductive voltage (V1) efficiently induced by the inductive element (32) is rectified by the high frequency detecting diode (31) and applied to the illuminant (23) as a large applied voltage (V2). Therefore, even though the high frequency energy is considerably small, the illuminant (23) can be lit stably and exactly.

(II) In the illuminant-mounted antenna (3) recited in above (I), the rod-shaped antenna element (10) is a whip antenna element capable of transmitting/receiving a very-high-frequency radio wave and an ultra-high-frequency radio wave and a portable transmitting/receiving antenna element mounted on the portable transceiver (1).

The antenna recited in (II) has the same advantage as that of the antenna recited in (I). Furthermore, it has the advantage of lighting the illuminant (23) stably and exactly even though the portable transceiver (1) is one whose output is reduced in an area of a strong electric field to prevent an incorporated battery from being consumed.

(III) In the illuminant-mounted antenna (3) recited in above (II), the illuminant (23) is a light-emitting diode (23) whose current ranges from 10 mA to 20 mA, and the inductive element (32) is a coil whose inductance ranges from 13 nH to 40 nH.

The antenna recited in (III) has the same advantage as that of the antenna recited in (II). Furthermore, it has the advantage of easily attaining the best mode of the present invention since the optimum values are specifically presented to perform an efficient lighting operation of the light-emitting diode (23).

(IV) In the illuminant-mounted antenna (3) recited in above (I) or (III), the light-emitting diode (23) and lighting means (24) are formed integrally as an illuminant unit (22), and the illuminant unit (22) is detachably mounted on the top of the rod-shaped antenna element (10).

The antenna recited in (IV) has the same advantage as that of the antenna recited in (I) or (III). Furthermore, it has the advantage of replacing the light emitting diode (23) with a new one through a simple operation if it fails.

(V) In the illuminant-mounted antenna (3) recited in above (IV), the illuminant unit (22) is detachably inserted into a hollow of a cylindrical holder (21) fixed on the top of the rod-shaped antenna element (10) and locked by a mounting cap (28) whose end portion is provided with a slit section (28*c*) serving as both a light irradiating window and a tool rotating groove.

The antenna recited in (V) has the same advantage as that of the antenna recited in (IV). Furthermore, it has the advantage of using the slit section (28*c*) as a tool rotating groove when the mounting cap (28) is attached and detached to replace the illuminant unit (22). The mounting cap (28) can be rotated quickly and exactly by inserting the tip of a tool such as a tubular box spanner and a screwdriver into the slit section (28*c*) and rotating it.

Additional advantages and modifications will readily occur to those skilled in the art. Therefore, the invention in its broader aspects is not limited to the specific details and representative embodiments shown and described herein. Accordingly, various modifications may be made without departing from the spirit or scope of the general inventive concept as defined by the appended claims and their equivalents.

We claim:

1. An illuminant-mounted antenna comprising:

a rod-shaped antenna element;

an illuminant mounted on top of the rod-shaped antenna element; and lighting means for lighting said illuminant by high frequency energy generated on said rod-shaped antenna element when a portable transceiver is operated, wherein said lighting means includes a high frequency detecting diode and an inductive element for generating a high frequency inductive voltage, one end of the high frequency detecting diode and one end of the inductive element are connected in common to the top of the rod-shaped antenna element, and the other end of the high frequency detecting diode and the other end of the inductive element are connected to both ends of said illuminant.

2. The illuminant-mounted antenna according to claim 1, wherein said rod-shaped antenna element is mounted on the portable transceiver and is a whip antenna element capable of transmitting/receiving a very-high-frequency radio wave and an ultra-high-frequency radio wave.

3. The illuminant-mounted antenna according to claim 2, wherein said illuminant is a light-emitting diode whose current ranges from 10 mA to 20 mA, and said inductive element is a coil whose inductance ranges from 13 nH to 40 nH.

4. The illuminant-mounted antenna according to claim 1, wherein said light-emitting diode and said lighting means are formed integrally as an illuminant unit, and said illuminant unit is detachably mounted on the top of said rod-shaped antenna element.

5. The illuminant-mounted antenna according to claim 3, wherein said light-emitting diode and said lighting means are formed integrally as an illuminant unit, and said illuminant unit is detachably mounted on the top of said rod-shaped antenna element.

6. The illuminant-mounted antenna according to claim 4, wherein said illuminant unit is detachably inserted into a hollow of a cylindrical holder fixed on the top of the rod-shaped antenna element and locked by a mounting cap whose end portion is provided with a slit section serving as both a light irradiating window and a tool rotating groove.

7. The illuminant-mounted antenna according to claim 5, wherein said illuminant unit is detachably inserted into a hollow of a cylindrical holder fixed on the top of the rod-shaped antenna element and locked by a mounting cap whose end portion is provided with a slit section serving as both a light irradiating window and a tool rotating groove.

* * * * *